US005845628A

United States Patent [19]

Pellerite

[11] Patent Number: 5,845,628

[45] Date of Patent: Dec. 8, 1998

[54] ARCHERY BOWSTRING RELEASE DEVICE AND METHOD

[76] Inventor: Bernard M. Pellerite, 255 SW. 96 La., Ocala, Fla. 34476

[21] Appl. No.: 45,722

[22] Filed: Mar. 21, 1998

[51] Int. Cl.[6] ..... F41B 5/18

[52] U.S. Cl. ..... 124/35.2

[58] Field of Search ..... 124/35.2

[56] References Cited

U.S. PATENT DOCUMENTS

| | | | |
|---|---|---|---|
| 3,898,974 | 8/1975 | Keck | 124/35.2 |
| 4,156,417 | 5/1979 | Fletcher | 124/35.2 |
| 4,316,443 | 2/1982 | Giacomo | 124/35.2 |
| 4,489,705 | 12/1984 | Larson | 124/35.2 |
| 4,665,886 | 5/1987 | Barlow | 124/35.2 |
| 4,854,293 | 8/1989 | Roberts | 124/35.2 |
| 4,969,448 | 11/1990 | Beyer | 124/35.2 |
| 5,009,214 | 4/1991 | Wilde | 124/35.2 |
| 5,031,600 | 7/1991 | Moore | 124/35.2 |
| 5,448,983 | 9/1995 | Scott | 124/35.2 |
| 5,595,167 | 1/1997 | Scott | 124/35.2 |
| 5,653,213 | 8/1997 | Linsmeyer | 124/35.2 |
| 5,685,286 | 11/1997 | Summers | 124/35.2 |

*Primary Examiner*—John A. Ricci
*Attorney, Agent, or Firm*—John V. Stewart

[57] ABSTRACT

In a trigger release for archery bows, a movable or stationary false trigger is mounted ahead of the active trigger. The archer hooks the end of the trigger finger on the false trigger, and the finger curves around the active trigger. During fine aiming the archer pulls the forearm rearward, and gradually relaxes and straightens the curve of the trigger finger, so that the second segment of the finger contacts the active trigger. This secondary contact smoothly operates the trigger without anticipation by the archer, whose sensory awareness is preoccupied by the more sensitive first pad of the trigger finger, which is pressing more firmly on the false trigger. This prevents anticipation, jerking of the active trigger, or flinching at the instant of release. An equivalent mechanism and method is disclosed for a thumb-activated trigger.

9 Claims, 6 Drawing Sheets

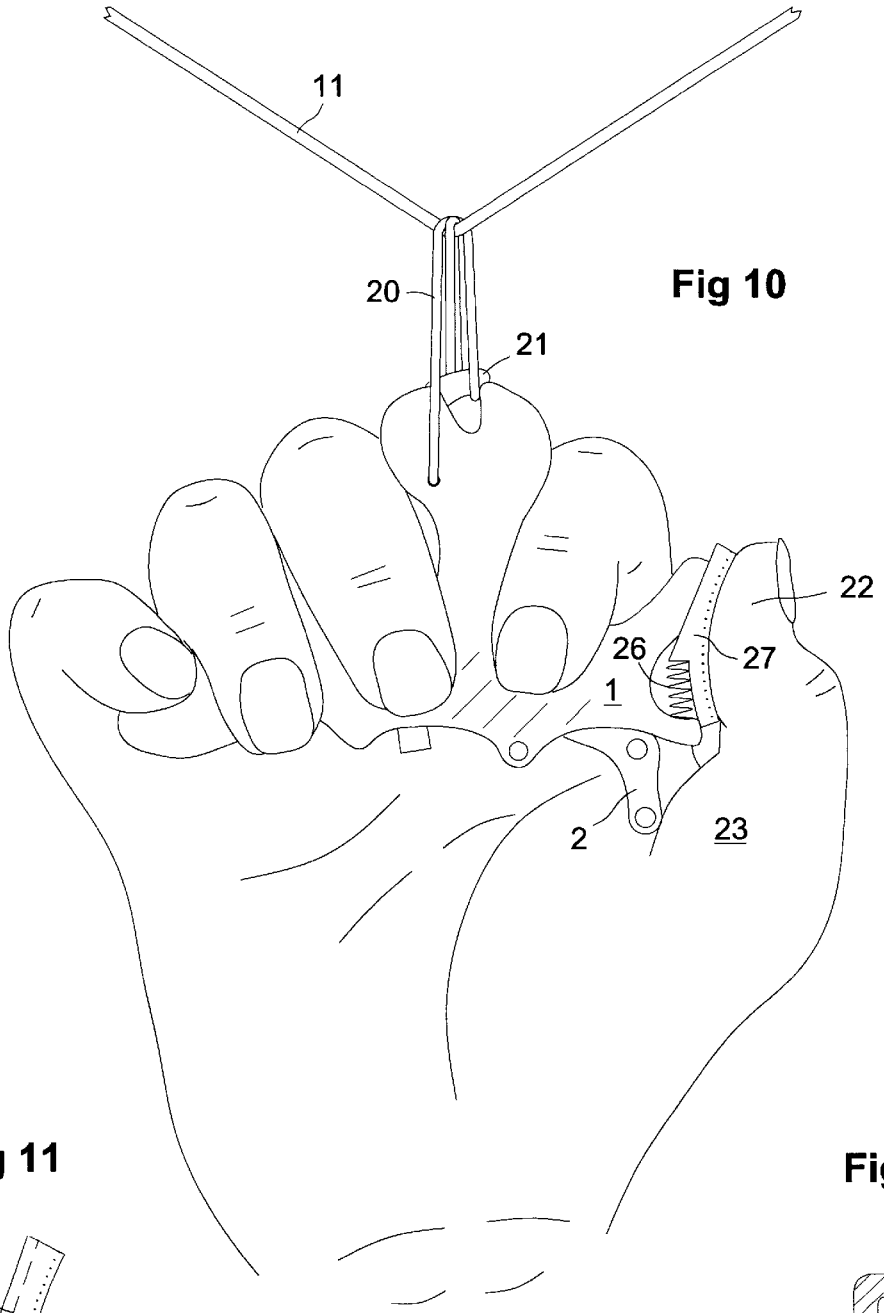
Fig 10
Fig 11
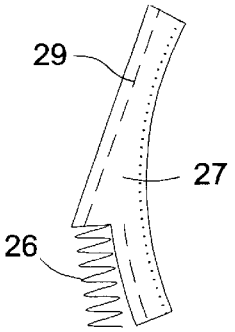
Fig 12
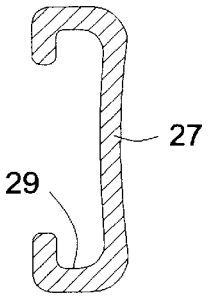

ARCHERY BOWSTRING RELEASE DEVICE AND METHOD

BACKGROUND OF THE INVENTION

1. Field of the Invention

This invention is in the field of archery bowstring release devices.

2. Description of Prior Art

Archery bows were originally drawn by hooking two or more fingers over the bowstring and pulling the string back from the bow. Archery technology now includes bowstring release devices, which assist the archer in gripping the bowstring securely, and releasing it smoothly. This eliminates distractions caused by the effort of gripping a bowstring directly with the fingers, and the resulting finger fatigue and soreness after multiple shots. These distractions impair an archer's concentration on aiming, and reduce the accuracy and repeatability of shots by changing the timing, consistency, and smoothness of release of the bowstring.

Representative examples of bowstring release devices are found in U.S. Pat. Nos. 5,685,286, 5,653,213, 5,595,167, 5,448,983, 4,489,705, 4,854,293, 4,316,443, and 4,156,417. These include versions for triggering by a finger and by the thumb.

Archers have a tendency to jerk the trigger of a release device, rather than to gradually pull through it for a smooth release. This is called "punching" the trigger. It is difficult to avoid due to the archer's intense concentration on aiming, often accompanied by an anxiety called "target panic" which increases the archer's impulsiveness. Efforts have been made to reduce tactile feedback from the trigger movement, so the archer does not feel the release coming, and therefore does not anticipate it or flinch in reaction. These efforts include reducing the trigger movement, making triggering force independent of the drawing force, and tripping the release via the angle of the hand or arm, rather than by a simple pull of a finger.

These solutions are not satisfactory for all archers. The present invention offers a new mechanism and method to trigger a bowstring release indirectly, which is natural and effective for most archers, and prevents anticipation or flinching.

SUMMARY OF THE INVENTION

The main objective of the present invention is reduction of tactile feedback from a bowstring release trigger, this hiding the exact moment of release from the archer to eliminate anticipation, jerking of the trigger, or flinching at the instant of release.

This objective is achieved as follows: A false trigger is mounted ahead of the active trigger. The archer hooks the end of a trigger finger on the false trigger, and the finger curves around the active trigger. During fine aiming, the archer pulls rearward with the forearm, while gradually relaxing the muscles in the hand and in the second and third joints in the trigger finger. This gradually stretches the curve of the trigger finger, so that the second segment of the finger contacts the active trigger. This secondary contact smoothly operates the trigger without anticipation by the archer, whose sensory awareness is preoccupied by the more sensitive first pad of the trigger finger pressing more firmly on the false trigger. This prevents anticipation, jerking of the active trigger, or flinching at the instant of release. An equivalent mechanism and method is disclosed for a thumb-activated trigger.

BRIEF DESCRIPTION OF THE DRAWINGS

FIG. 10 Shows a bowstring release device for operation by the thumb, with a sliding version of the thumb cup, in drawn position ready for aiming.

FIG. 11 Shows a side view of the sliding thumb cup of FIG. 10.

FIG. 12 Shows an end sectional view of the sliding thumb cup of FIG. 10.

REFERENCE NUMERALS

Figure 1:
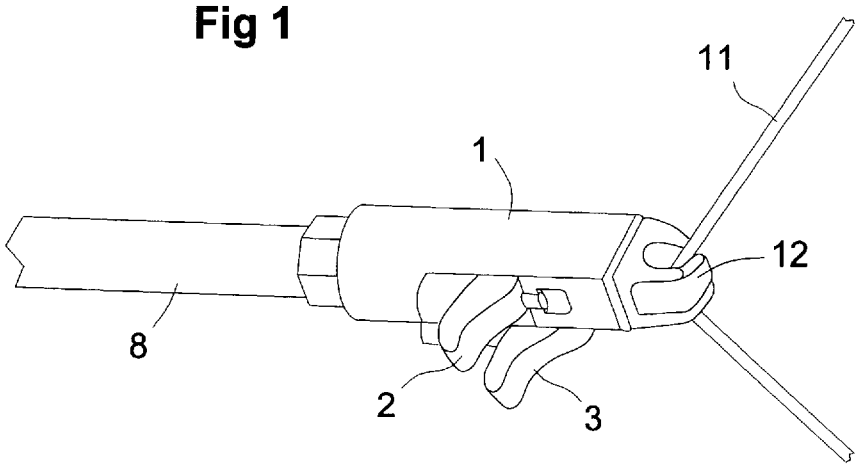
FIG. 1 Shows an archery bowstring release device with an active trigger and a false trigger according to the invention.

1. Case of bowstring release device
2. Active trigger
3. False trigger
5. Adjustment screw of inactive trigger
6. Adjustment slot of inactive trigger
7. Wrist strap
8. Connecting cord or rod
9. First segment of index finger
10. Second segment of index finger
11. Bowstring
12. Bowstring hook or caliper
20. Bowstring engagement loop
21. Bowstring engagement loop retention hook
22. First segment of thumb
23. Base of thumb
24. Pivoting thumb cup
25. Pivot point of thumb cup
26. Spring of thumb cup
27. Sliding thumb cup
29. Channel of sliding thumb cup

DESCRIPTION OF THE PREFERRED EMBODIMENTS

For precision in the description and claims, the following terms are defined: "Digit" means any of the 5 fingers of a hand, including the thumb. "Segment" means a rigid section of a digit, defined by a finger bone, or phalange. "Joint" means the joint or hinge between segments. The "first" segment or pad of a digit means the distal one (farthest from the base). "Static" contact means static, or non-sliding, friction between the digit and the surface of the inactive trigger or thumb cup.

Figure 2:
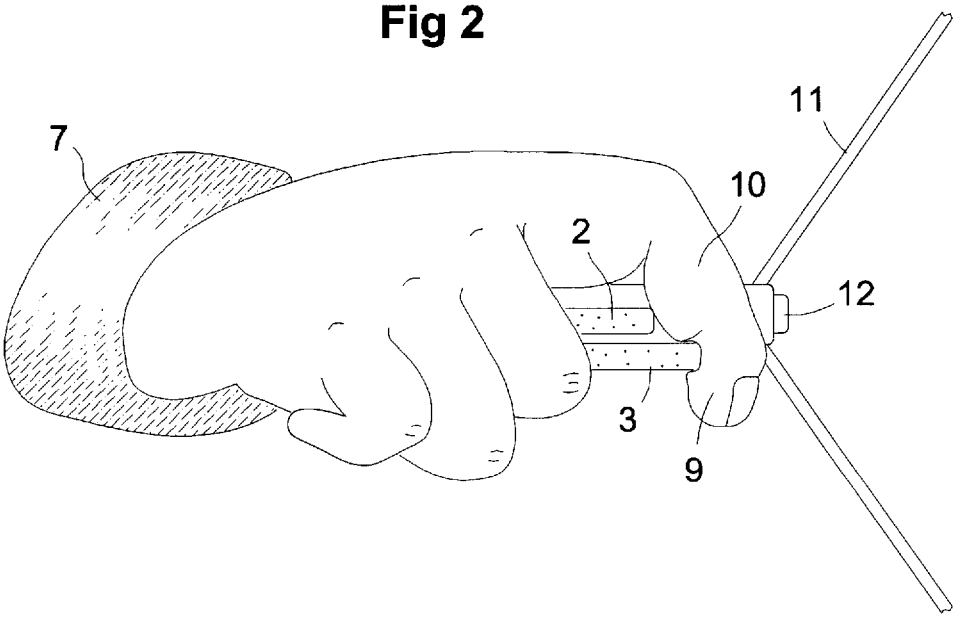
FIG. 2 Shows the device of FIG. 1 strapped onto the wrist in drawn position ready for aiming, with the trigger finger on the false trigger.
Figure 3:
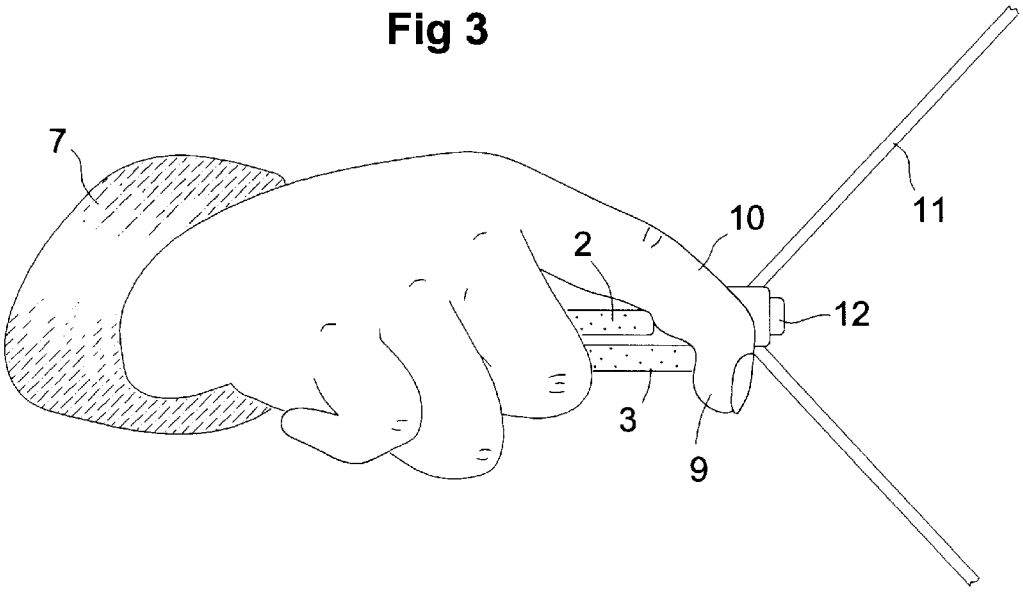
FIG. 3 Shows the device of FIG. 1 strapped onto the wrist, with the trigger finger straightened and contacting the active trigger.
Figure 4:
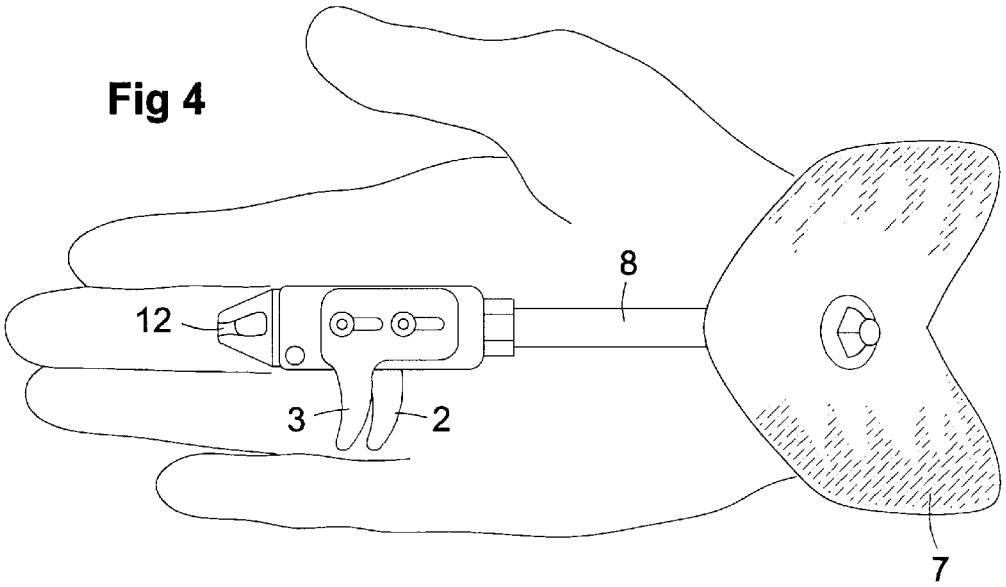
FIG. 4 Shows the device of FIG. 1 as seen from the palm side of the hand.

FIG. 1 shows a bowstring release device having a case (1), an active trigger (2), a false trigger (3), and a connecting cord or rod (8) leading to a wrist strap (not shown). FIG. 2 shows this device attached to the right wrist by a wrist strap (7) for operation by the right index finger. The wrist strap transfers the bow drawing force directly to the wrist, eliminating stress on the fingers. In FIG. 2, the first segment of the index finger is hooked over the false trigger (3), while the second segment of the index finger curves away from the active trigger (2). FIG. 3 shows the index finger relaxing and straightening, allowing its second segment (10) to contact the active trigger This contact is unnoticed by the archer, who is concentrating on fine aim and follow-through. The contact of the first pad of the finger on the false trigger takes priority in the archer's awareness over the secondary contact of the finger on the active trigger.

Operation of the invention is as follows:

1. Fully draw the bow.
2. Aim close to the target.
3. Pull on the false trigger with the first pad of the trigger finger.
4. Concentrate on fine aiming while pulling rearward with the forearm and gradually relaxing and stretching the curve in the trigger finger.
5. The second segment of the trigger finger will trip the active trigger without anticipation.
6. Concentrate on hitting the target or on a smooth follow-through motion.

Figure 5:
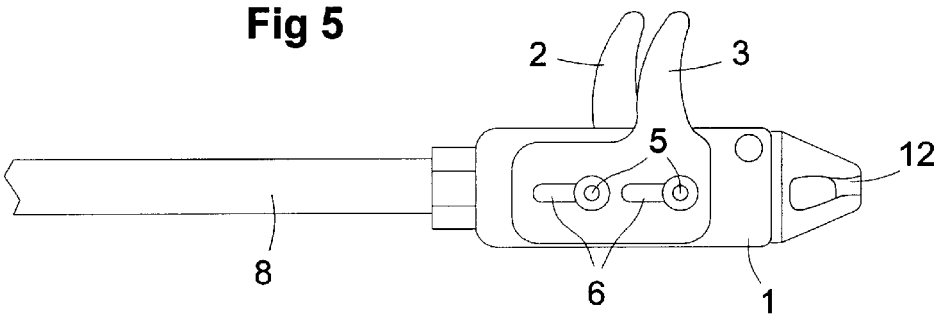
FIG. 5 Shows a back view of the device of FIG. 1.

Trigger release devices have adjustments for proper fit in the users hand. They may also provide one or more adjustments on the active trigger to modify its sensitivity, range, and/or release point. The false trigger should be adjusted in cooperation with other available adjustments so release occurs after about 3 to 5 seconds of fine aim. As shown in FIG. 5, the false trigger preferably has adjustment screws (5) in elongated slots (6) for setting the distance between the false and active triggers. Reducing this distance reduces the release time, and vice versa.

Figure 6:
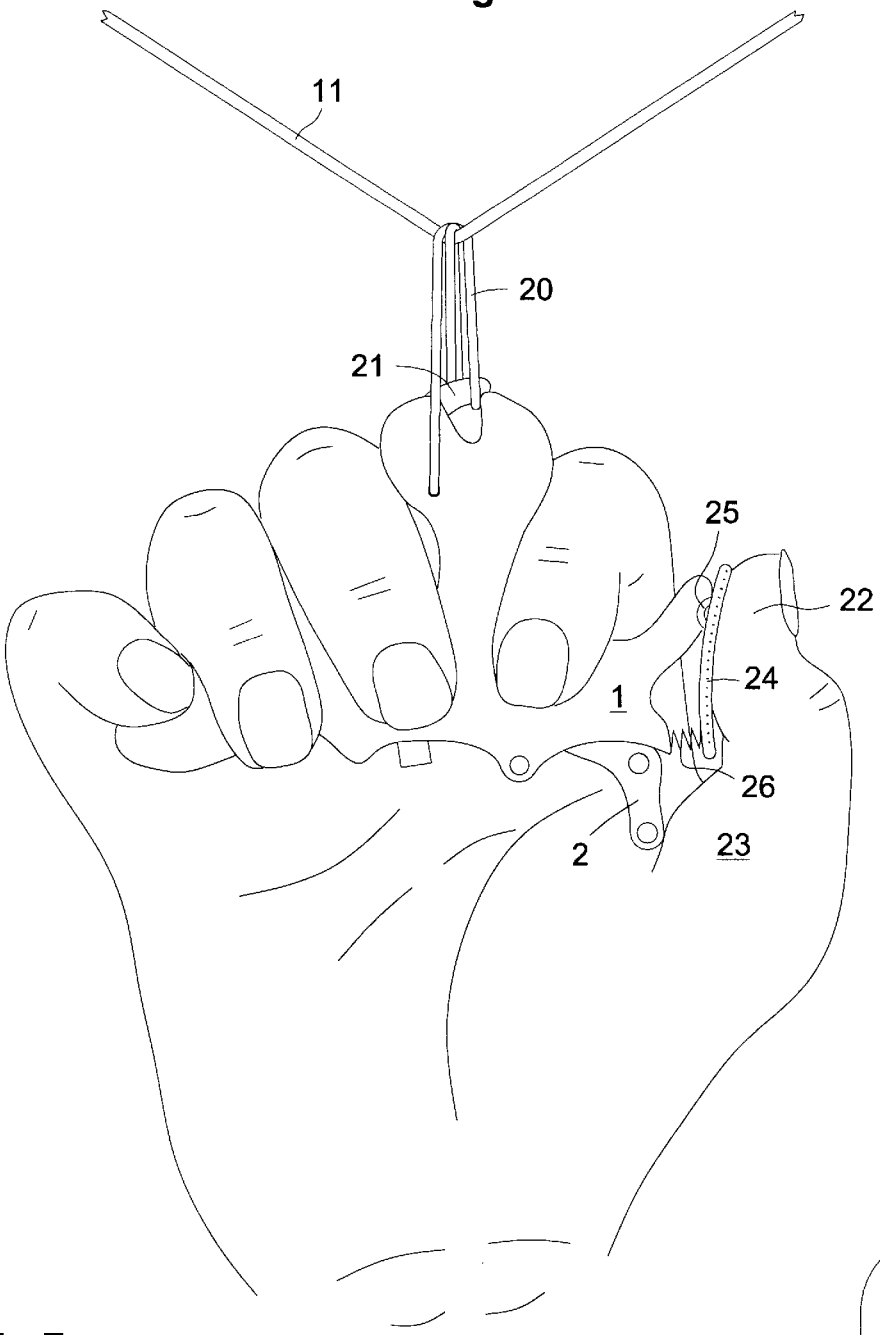
FIG. 6 Shows a bowstring release device for operation by the thumb in drawn position ready for aiming.
Figure 7:
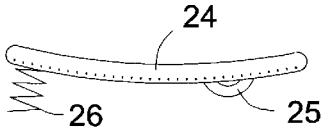
FIG. 7 Shows a side view of the pivoting thumb cup of FIG. 6.
Figure 8:
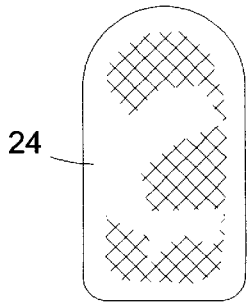
FIG. 8 Shows a top view of the pivoting thumb cup of FIG. 6.
Figure 9:
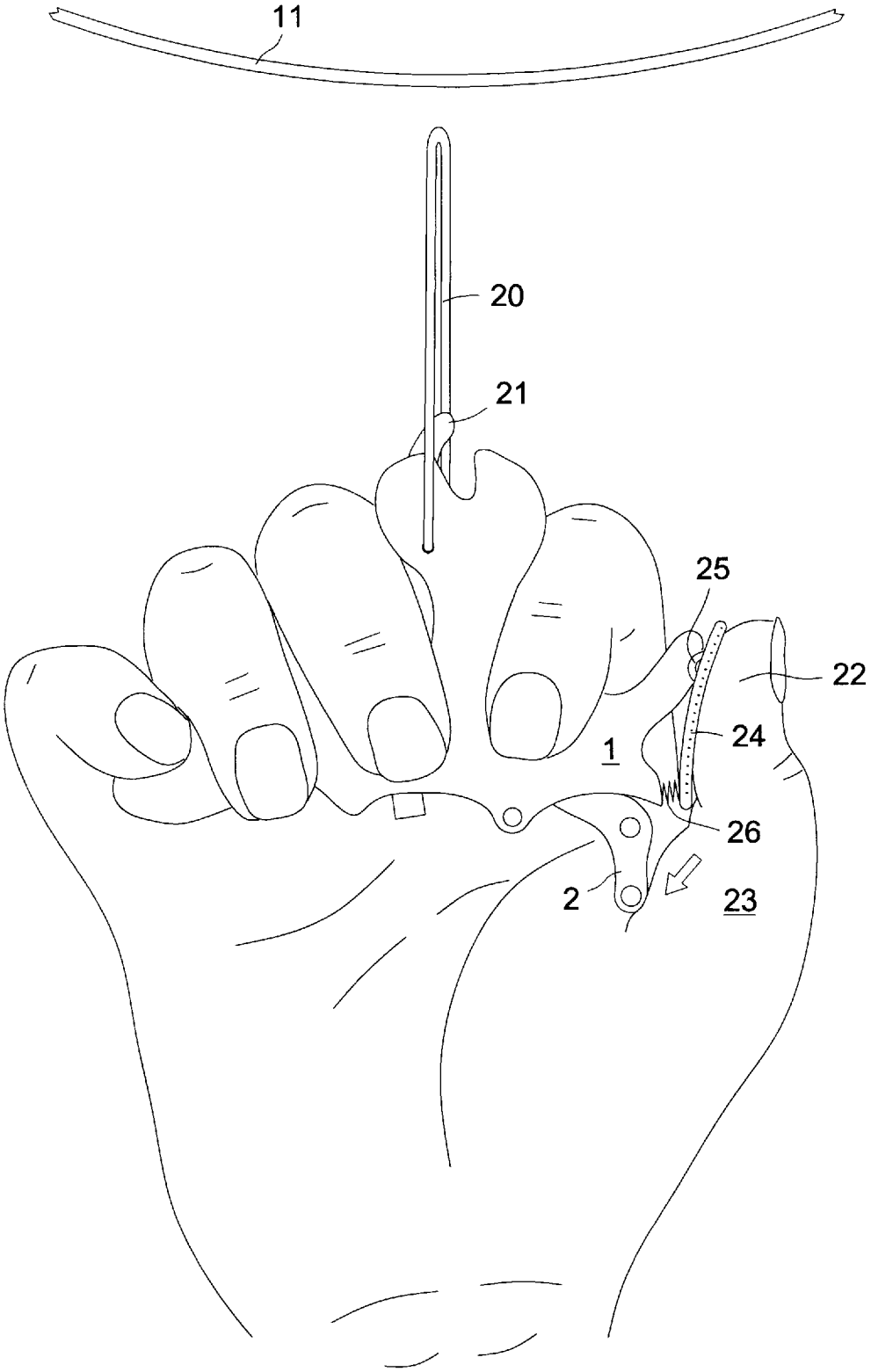
FIG. 9 Shows the device of FIG. 6 just after release.
Figure 13:
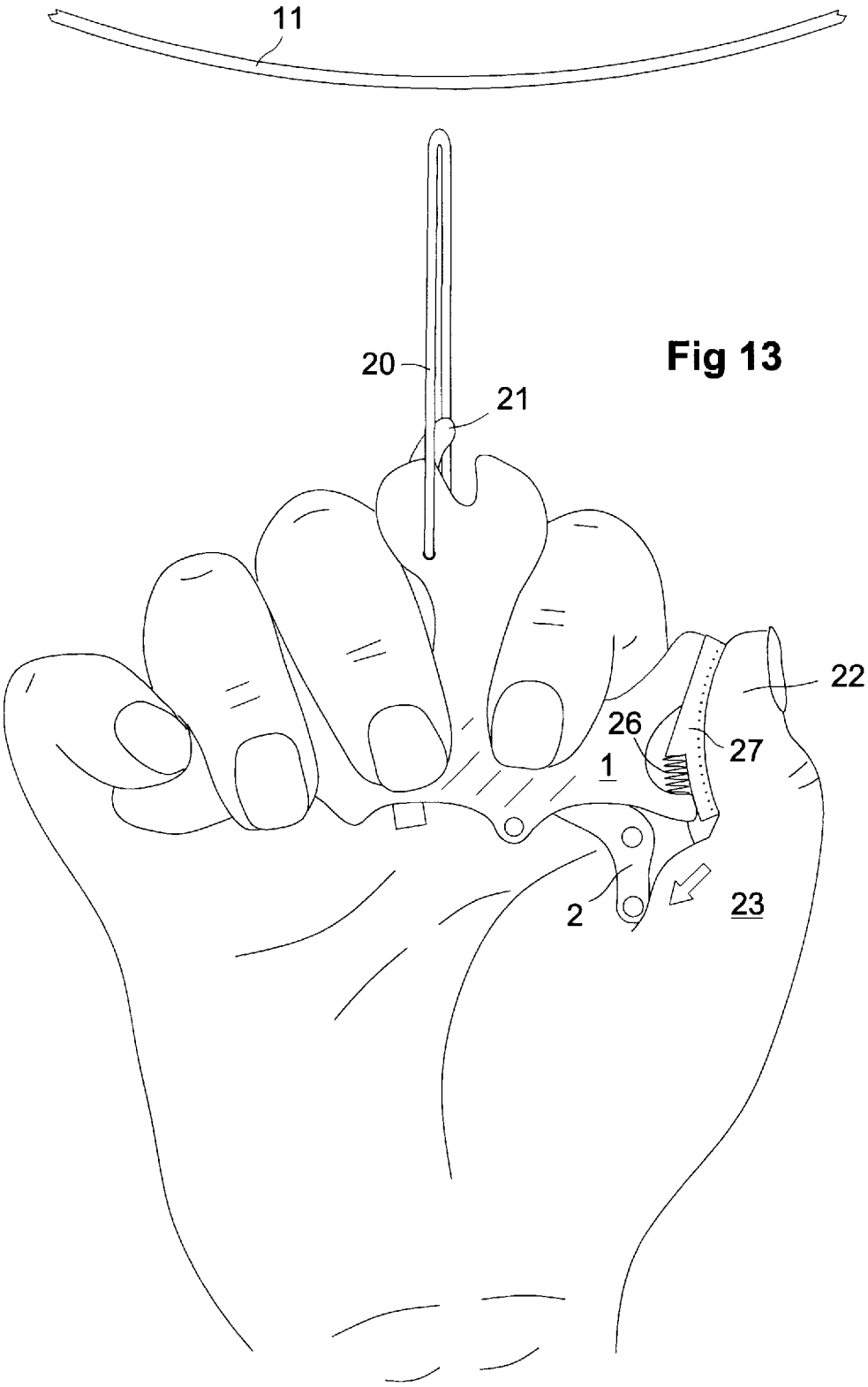
FIG. 13 Shows the device of FIG. 10 just after release.

Application of this invention to a thumb-operated trigger requires consideration of the differences in the thumb from the other digits. The thumb resists straightening when its tip is bent. A good contact point for a thumb trigger is the base of the thumb as shown in FIG. 6. A pivoting thumb cup (24) is the inactive trigger. It maintains static contact with the thumb tip as the base of the thumb moves back against the active trigger. The thumb cup is urged away from the active trigger (1) by a spring (26). The archer's sensory attention is occupied by contact with the thumb cup, ignoring the secondary contact of the active trigger on the base of the thumb. A slight modification of the pivoting thumb cup is a sliding thumb cup as shown in FIGS. 10–13. This cup has a channel which is slidably mounted on a mating track on the case (not shown). This retains the cup while allowing it to slide toward the active trigger against a spring (26).

Operation of a thumb-release version of the invention is as follows:

1. Fully draw the bow.
2. Aim close to the target.
3. Place the first pad of the thumb on the thumb cup.
4. Concentrate on fine aiming while pulling rearward with the forearm and gradually sliding or pivoting the thumb cup against the spring until the base of the thumb trips the active trigger.
5. The base of the thumb will trip the active trigger without anticipation.
6. Concentrate on hitting the target or on a smooth follow-through motion.

The invention is not limited to a particular finger as the trigger finger. Any finger or the thumb can be used as the trigger finger, depending on the design of the bowstring release, with appropriate adaptation for the thumb as described above. The inactive trigger may be stationary or movable. It is preferably movable in the thumb embodiment as shown, and preferably stationary for the other fingers.

Although the present invention has been described herein with respect to preferred embodiments, it will be understood that the foregoing description is intended to be illustrative, not restrictive. Modifications of the present invention will occur to those skilled in the art. All such modifications which fall within the scope of the appended claims are intended to be within the scope and spirit of the present invention.

I claim:

1. An archery bowstring release device of a type having a case, an active trigger, and bowstring retention means operatively coupled to the active trigger for releasing a bowstring upon movement of the active trigger, characterized by an inactive trigger attached to the case ahead of the active trigger for engaging the first pad of a digit of an archer's hand and maintaining static contact with said pad while a secondary portion of said digit moves rearward and trips the active trigger.

2. The archery bowstring release device of claim 1, wherein the inactive trigger is a stationary trigger mounted ahead of the active trigger and laterally offset therefrom.

3. The archery bowstring release device of claim 1, wherein the inactive trigger is a movable false trigger urged away from the active trigger by a spring.

4. A method of triggering, without anticipation, an archery bowstring release device having an active trigger, using a triggering digit of a hand, comprising the steps of:

a) providing an inactive trigger on the release device ahead of the active trigger;

b) placing the pad of the first segment of the triggering digit on the inactive trigger;

c) pulling said pad against the inactive trigger, and c) tripping the active trigger by contacting it at a secondary point on the triggering digit.

5. The method of claim 4, wherein the triggering digit is the index finger, and the inactive trigger is a stationary trigger mounted ahead of the active trigger and laterally offset therefrom, in a position causing the second segment of the index finger to trip the active trigger when the index finger is straightened while the first pad of the index finger pulls against the stationary trigger.

6. The method of claim 4, wherein the triggering digit is the thumb, and the inactive trigger is a movable false trigger urged forward by a spring.

7. An archery bowstring release device for shooting a bow without flinching, comprising:

a case;

an active trigger attached to the case;

bowstring retention means coupled to the active trigger for releasing a bowstring upon movement of the active trigger; and a pressure surface attached to the case ahead of the active trigger for static surface contact with the distal segment of a digit of an archer's hand;

whereby an archer can place the distal segment of a digit on the pressure surface, and move the base of the digit back so that the digit contacts the active trigger at a secondary point on the digit while maintaining static surface contact between the distal end of said digit and the pressure surface.

8. The archery bowstring release device of claim 7, wherein the pressure surface is a false trigger mounted ahead of the active trigger and laterally offset therefrom.

9. The archery bowstring release device of claim 7, wherein the pressure surface is a movable cup urged away from the active trigger by a spring.

* * * * *